US012448169B2

(12) United States Patent
Takahashi

(10) Patent No.: US 12,448,169 B2
(45) Date of Patent: Oct. 21, 2025

(54) PACKAGING MEMBER

(71) Applicant: KYOCERA Document Solutions Inc., Osaka (JP)

(72) Inventor: Akinari Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/547,058

(22) PCT Filed: Jan. 18, 2023

(86) PCT No.: PCT/JP2023/001293

§ 371 (c)(1),
(2) Date: Aug. 18, 2023

(87) PCT Pub. No.: WO2023/145561

PCT Pub. Date: Aug. 3, 2023

(65) Prior Publication Data

US 2024/0140643 A1 May 2, 2024

(30) Foreign Application Priority Data

Jan. 26, 2022 (JP) ..... JP2022-010080

(51) Int. Cl.
*B65D 5/50* (2006.01)
*B65D 5/20* (2006.01)

(52) U.S. Cl.
CPC ..... *B65D 5/5021* (2013.01); *B65D 5/2057* (2013.01)

(58) Field of Classification Search
CPC ..... B65D 5/5021; B65D 5/2057
USPC ..... 206/521
See application file for complete search history.

(56) References Cited

U.S. PATENT DOCUMENTS 1,383,148 A * 6/1921 Pinkerton ..... B65D 5/302 229/149
1,791,196 A * 2/1931 Deutschmeister ... B65D 5/6655 229/149

FOREIGN PATENT DOCUMENTS

CN 210116836 U * 2/2020
JP 2009-107674 A 5/2009

* cited by examiner

*Primary Examiner* — Nathan J Jenness
*Assistant Examiner* — Jessica Kavini Tamil
(74) *Attorney, Agent, or Firm* — Stein IP LLC

(57) ABSTRACT

A packaging member (100) has a pair of holding portions (230) folded from opposite edges of each of a pair of first wall portions (210); the pair of holding portions (230) have an opposed portion (230*a*) opposed to a second wall portion (220), and an insertion piece (231); the second wall portion (220) has a wall-portion slit (221); and by inserting the insertion piece (231) in the wall-portion slit (221), the first wall portions (210) and the second wall portion (220) are held in a standing state.

9 Claims, 8 Drawing Sheets

PACKAGING MEMBER

CROSS-REFERENCE TO RELATED APPLICATIONS

This application is a national stage of International Application No. PCT/JP2023/001293, filed Jan. 18, 2023, which claims the benefit of Japanese Application No. 2022-010080, filed Jan. 26, 2022, in the Japanese Patent Office, the disclosures of which are incorporated herein by reference.

TECHNICAL FIELD

The present invention relates to a packaging member.

BACKGROUND ART

Conventionally, packaging members constituted of cardboard sheets have been known. An example of such packaging members is disclosed in patent document 1 identified below.

The packaging member of the patent document 1 includes a plurality of cardboard parts. The packaging member of the patent document 1 is formed by combining the plurality of parts.

CITATION LIST

Patent Literature

Patent Document 1: Japanese Unexamined Patent Application Publication No. 2009-107674

SUMMARY OF INVENTION

Technical Problem

According to Patent Document 1, when assembling the packaging member, it is necessary to appropriately fit each of the plurality of parts to its counterpart, and this deteriorates workability. Furthermore, in disassembling and discarding the packaging member, it is necessary to detach each of the plurality of parts from its counterpart, and this also deteriorates workability. Moreover, when disassembled, the packaging member is separated into the plurality of parts which need to be bundled, and this makes the discarding process troublesome.

The present invention has been made to solve these problems, and an object of the present invention is to provide a packaging member that is capable of improving workability in assembling and disassembling (a discarding process of) the packaging member.

Solution to Problem

To achieve the above object, according to one aspect of the present invention, a packaging member is one having a containing area formed by folding a single cardboard sheet, and the packaging member includes a bottom portion having a rectangular shape, and a wall portion that is folded from a perimeter of the bottom portion to be erected upward and that forms a side surface of the containing area. The wall portion has a pair of first wall portions that are disposed opposite to each other across the containing area in a first direction and that are each folded inward into a polygonal-tube shape, a pair of second wall portions that are disposed opposite to each other across the containing area in a second direction orthogonal to the first direction, and a pair of holding portions that are folded, toward the first direction, from opposite edges of each of the pair of first wall portions in the second direction. The pair of holding portions have an opposed portion that is disposed opposite to an inner surface of the second wall portions, and an insertion piece that is formed by further folding, toward the second direction, a side thereof opposite to a side of connection with the first wall portions. The second wall portions have a wall-portion slit. By inserting the insertion piece in the wall-portion slit, the first wall portions and the second wall portions are held in a standing state.

Advantageous Effects of Invention

With the configuration of the present invention, it is possible to improve workability of assembling and disassembling (a discarding process of) a packaging member.

DESCRIPTION OF EMBODIMENTS

Figure 1:
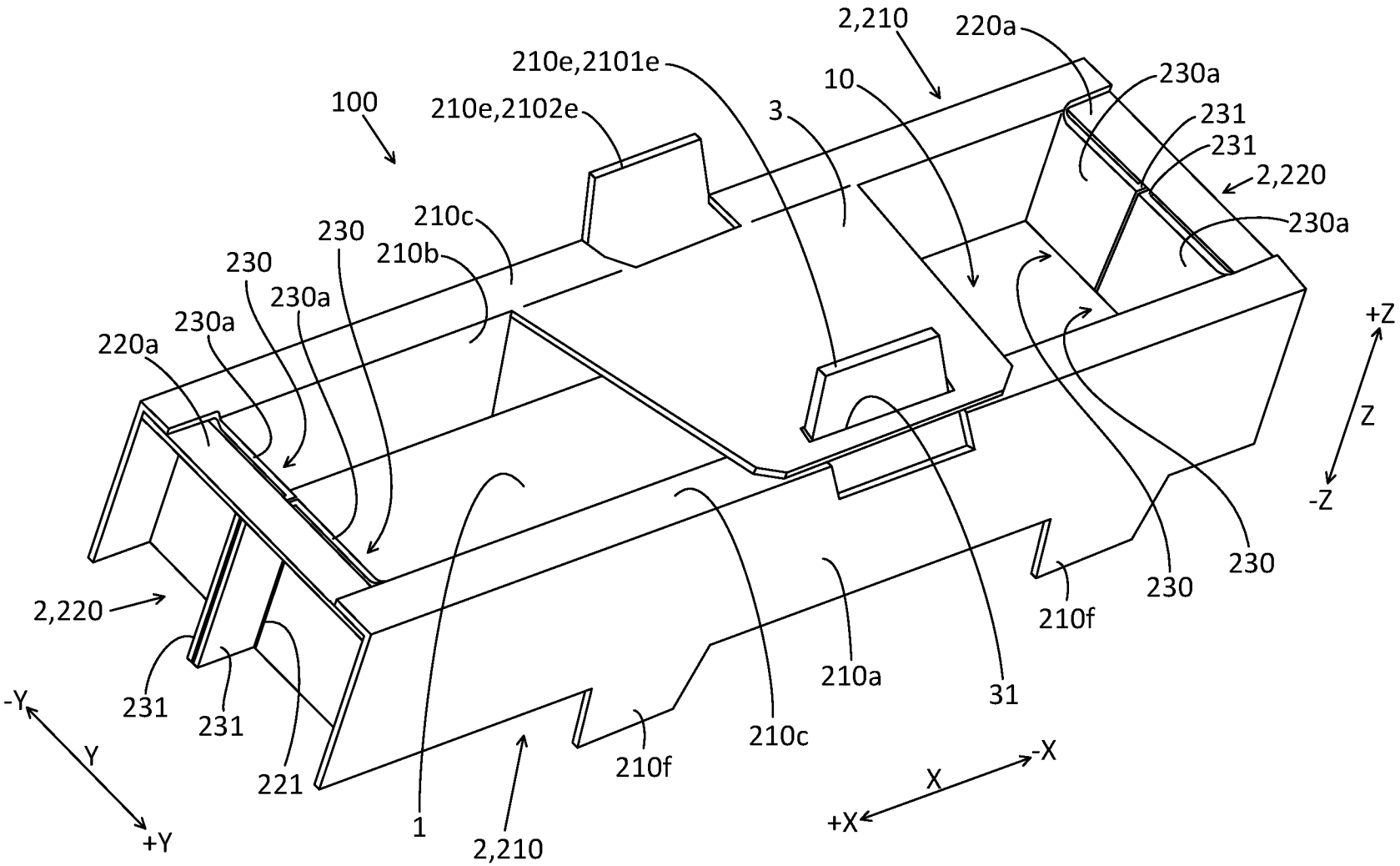
FIG. 1 is a perspective view of a packaging member according to one embodiment.

Hereinafter, with reference to FIGS. 1 to 7, a description will be given of a packaging member 100 according to the present embodiment. In the following description, a direction X in the drawings is defined as a left-right direction, a direction Y is defined as a front-rear direction, and a direction Z is defined as an up-down direction. The direction Y (the front-rear direction) corresponds to a "first direction," and the direction X (the left-right direction) corresponds to a "second direction."

In the direction X, a +X side is defined as left, and a −X side is defined as right. In the direction Y, a +Y side is defined as front, and a −Y side is defined as rear. In the direction Z, a +Z side is defined as up, and a −Z direction is defined as down.

<Schematic Structure of Packaging Member>

Figure 2:
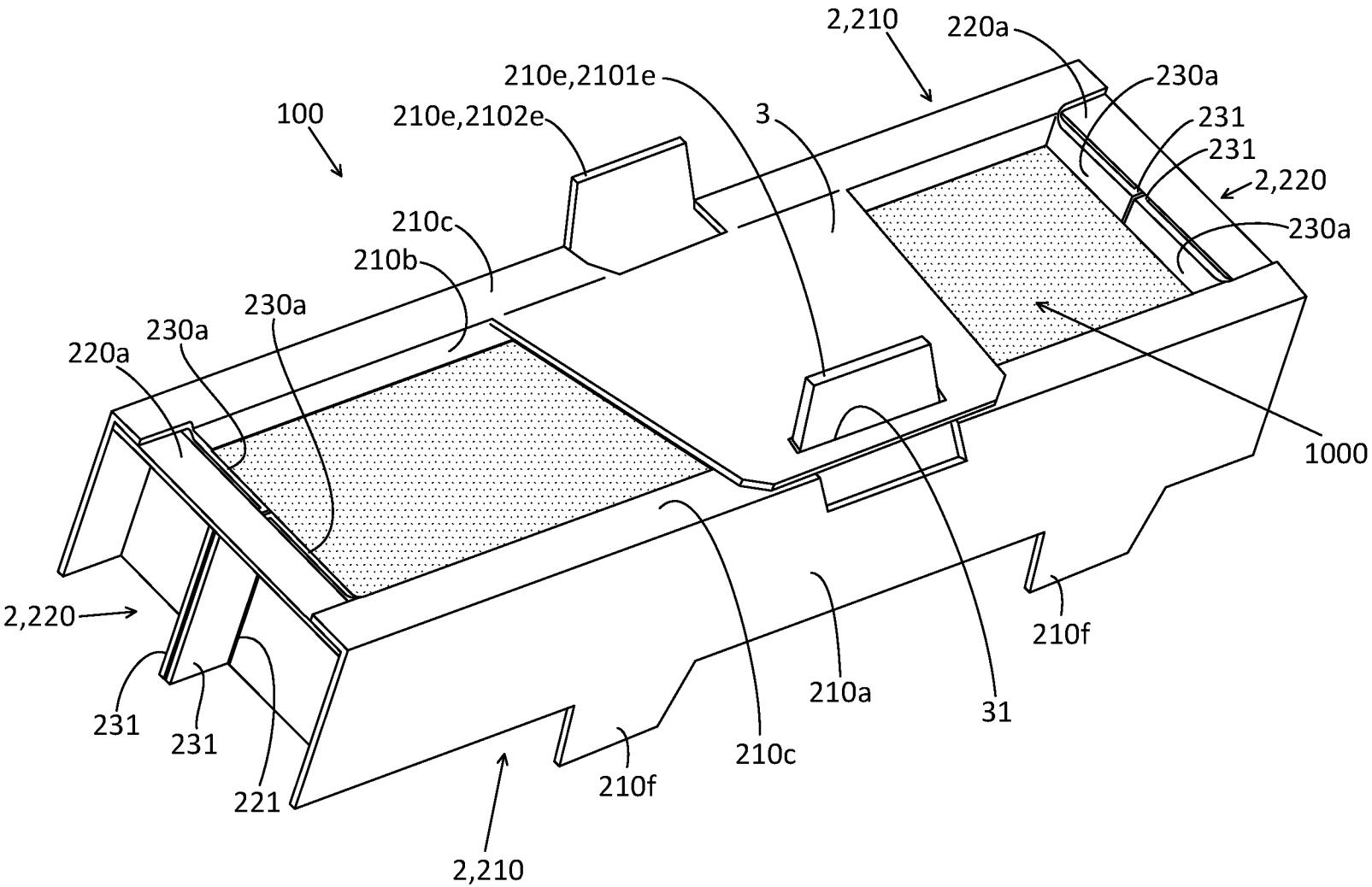
FIG. 2 is a perspective view showing a state in which a packaged object is contained in the packaging member.
Figure 3:
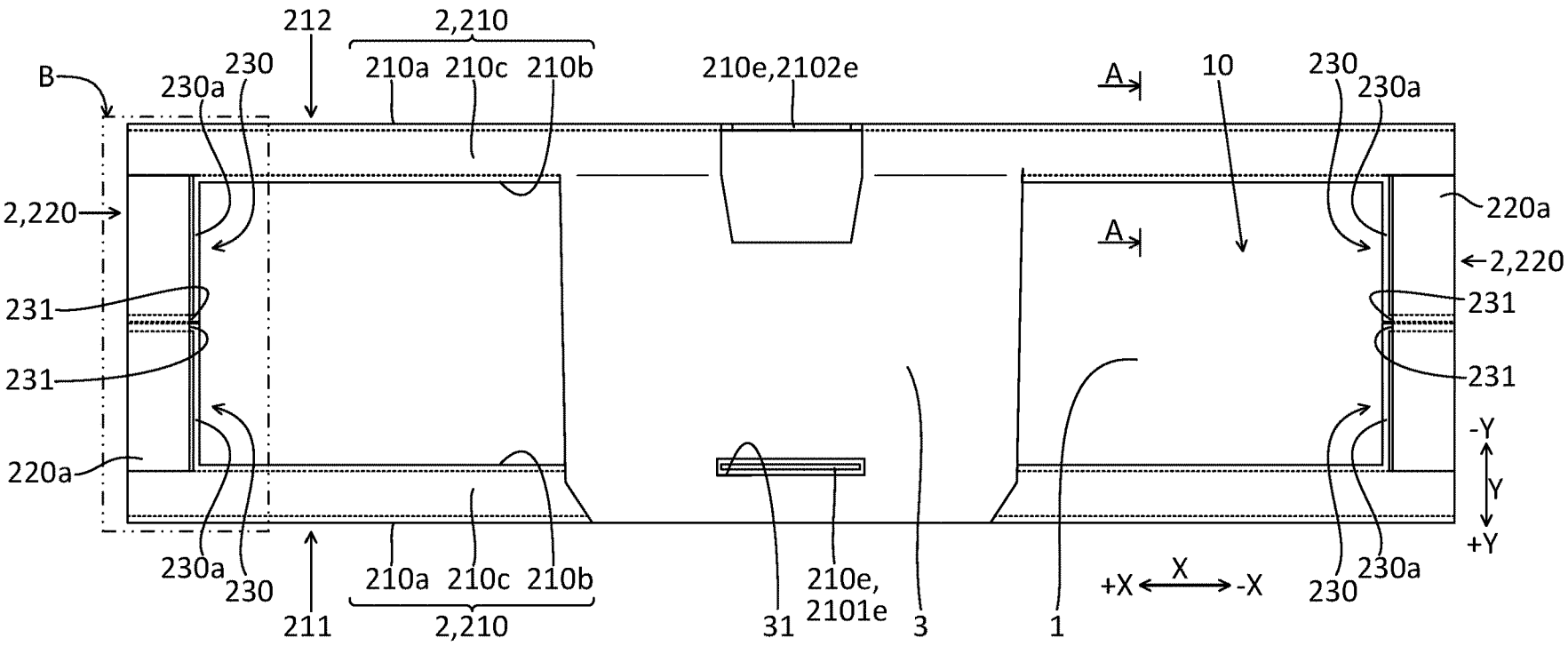
FIG. 3 is a plan view of the packaging member according to one embodiment as seen from above.

As shown in FIGS. 1 to 3, the packaging member 100 of the present embodiment has a containing area 10 in which to contain a packaged object 1000 (see FIG. 2). In FIG. 2, the packaged object 1000 is indicated with a dotted pattern. As seen from above, the containing area 10 has a rectangular shape (including a substantially rectangular shape) with its longitudinal direction along a left-right direction. However, this is not meant as a limitation. The containing area 10, as seen from above, may have a rectangular shape with its longitudinal direction along a front-rear direction instead. Or, the containing area 10, as seen from above, may have a square shape instead.

Figure 8:
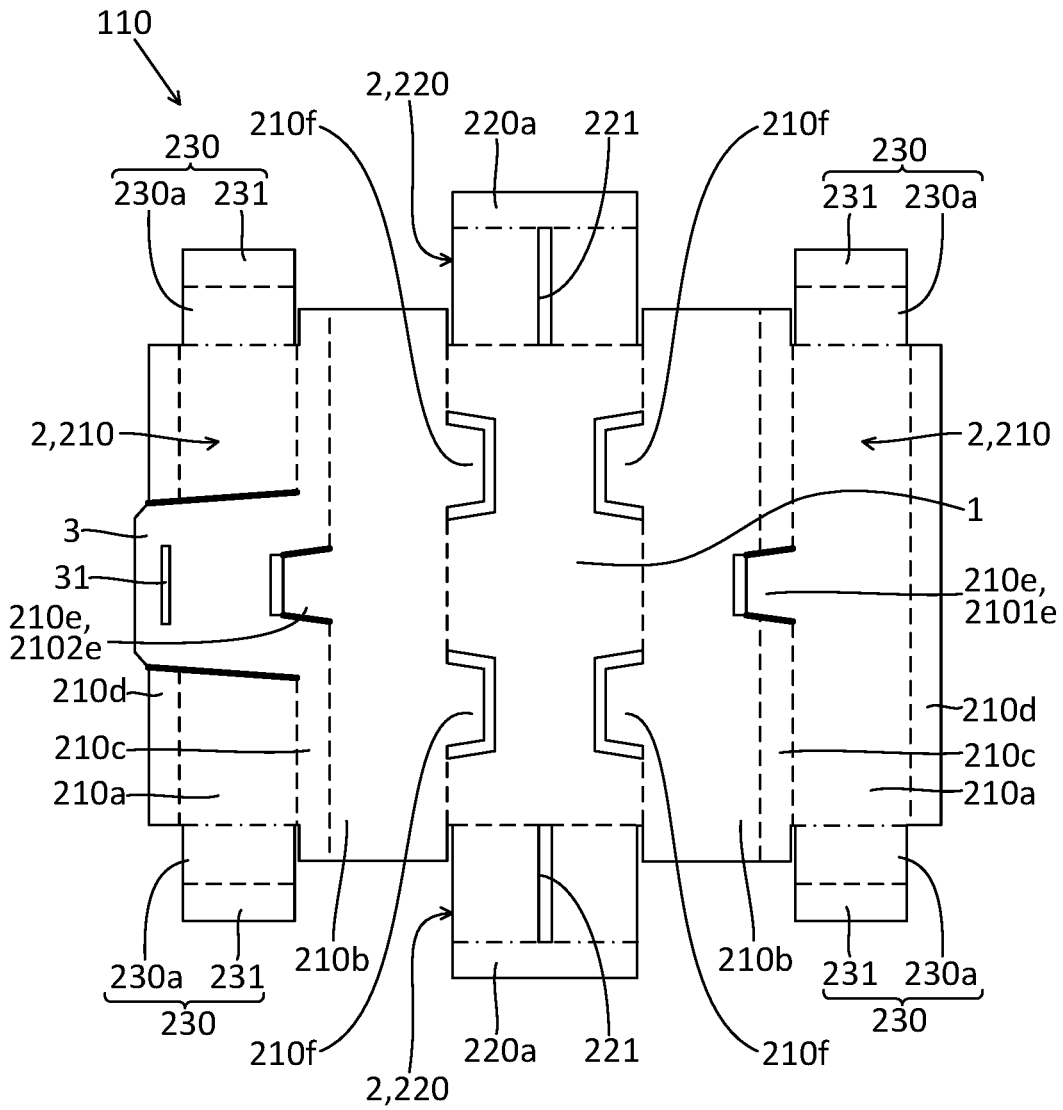
FIG. 8 is a development view (a plan view of a cardboard sheet) of a packaging member according to one embodiment.

The packaging member 100 is constituted of a single cardboard sheet 110 (see FIG. 8). That is, the containing area 10 is formed by folding the single cardboard sheet 110. A detailed description will be given later.

The packaging member 100 includes a bottom portion 1 having a rectangular shape. On an upper surface of the bottom portion 1, the packaged object 1000 is placed. That is, the bottom portion 1 covers the packaged object 1000 from below. When contained in the containing area 10, the packaged object 1000 has its bottom protected by the bottom portion 1.

The packaging member 100 further includes a wall portion 2. The wall portion 2 is extended from a perimeter of the bottom portion 1, and is perpendicularly (including substantially perpendicularly) erected upward from the bottom portion 1. The wall portion 2 is such part of the cardboard sheet 110 (see FIG. 8) as is folded from the perimeter of the bottom portion 1 to be erected upward. The wall portion 2 is held in a standing state, and thereby forms side surfaces of the containing area 10. In other words, as seen from above, the wall portion 2 surrounds the containing area 10. When contained in the containing area 10, the packaged object 1000 has its side surfaces protected by the wall portion 2.

When contained in the containing area 10, the packaged object 1000 contacts an inner surface of the wall portion 2 (a surface defining the containing area 10). This helps suppress positional deviation (shaking) of the packaged object 1000 inside the containing area 10. In a case where there is a gap between the inner surface of the wall portion 2 and the packaged object 1000, the gap may be filled by inserting a cushion member (not shown) or the like into the gap.

The wall portion 2 includes a pair of wall portions 210 that are disposed opposite to each other across the containing area 10 in the front-rear direction (which corresponds to a "first direction"). In the following description, in a case where it is necessary to distinguish front and back of the wall portion 2, the front portion of the wall portion 2 will be denoted by a reference number 211 and will be referred to as a front wall portion 211 (see FIG. 3), and the rear portion of the wall portion 2 will be denoted by a reference number 212 and will be referred to as a rear wall portion 212 (see FIG. 3). The pair of wall portions 210 (the front wall portion 211 and the rear wall portion 212) correspond to "first wall portions."

The wall portion 2 further includes a pair of wall portions 220 that are disposed opposite to each other across the containing area 10 in the left-right direction (which corresponds to a "second direction"). The wall portion 220 on the left side and the wall portion 220 on the right side are identical to each other in structure. In the following description, the wall portions 220 on the left and right sides will be referred to as lateral wall portions 220. The pair of wall portions 220 (that is, the pair of lateral wall portions 220) correspond to "second wall portions."

First, the front wall portion 211 and the rear wall portion 212 will be described.

As seen from above, the front wall portion 211 and the rear wall portion 212 extend parallel (including substantially parallel) to the left-right direction. When the packaged object 1000 is contained in the containing area 10, the front wall portion 211 and the rear wall portion 212 hold the packaged object 1000 therebetween in the front-rear direction.

Figure 4:
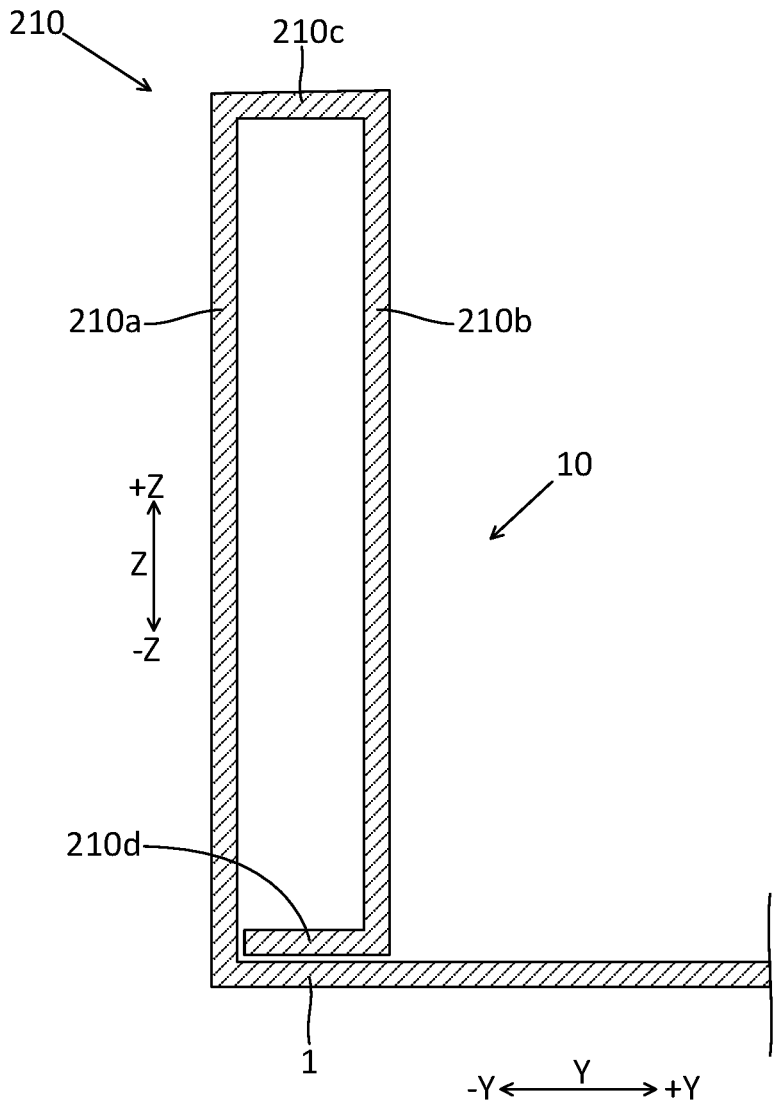
FIG. 4 is a sectional view taken along line AA in FIG. 3.

The front wall portion 211 and the rear wall portion 212 are each folded inward into a polygonal-tube shape, thereby having a structure as shown in FIG. 4. The front wall portion 211 and the rear wall portion 212 are basically identical to each other in configuration. Thus, the description will be given without illustration of the front wall portion 211.

The front wall portion 211 has an outer wall 210*a* and an inner wall 210*b*. The outer wall 210*a* is a portion that is positioned more outward than the inner wall 210*b* with respect to the containing area 10, and the inner wall 210*b* is a portion that defines the containing area 10. Likewise, the rear wall portion 212 also has an outer wall 210*a* and an inner wall 210*b*. A lower edge of the outer wall 210*a* is connected to the bottom portion 1. By a boundary between the bottom portion 1 and the outer wall 210*a* being folded, the outer wall 210*a* is brought into a state of being erected upward from the bottom portion 1.

An upper edge of the outer wall 210*a* is connected, via a top end portion 210*c*, to an upper edge of the inner wall 210*b*. The top end portion 210*c* is folded to be perpendicular (including substantially perpendicular) with respect to the outer wall 210*a*. The inner wall 210*b* is folded to be perpendicular (substantially perpendicular) with respect to the top end portion 210*c*, and thereby extends downward into contact with the bottom portion 1. Thus, the inner wall 210*b* is brought into a state of being opposed to the outer wall 210*a* across an interval in the front-rear direction and being erected upward from the bottom portion 1. A lower edge of the inner wall 210*b* is connected to a bottom end portion 210*d*. The bottom end portion 210*d* is folded to be perpendicular (including substantially perpendicular) with respect to the inner wall 210*b* so as to extend toward the outer wall 210*a*. For clarity of representation, in FIG. 4, the bottom end portion 210*d* and a portion in contact with the bottom end portion 210*d* are illustrated to be apart from each other.

In a case where inward impact is applied to the front wall portion 211 or to the rear wall portion 212 from outside the containing area 10, first, each of the top end portion 210*c* and the bottom end portion 210*d* crushes. Thereby, the impact on the packaged object 1000 is mitigated. That is, the top end portion 210*c* and the bottom end portion 210*d*, by each being folded inward to form the polygonal-tube shape, function as cushion members.

The front wall portion 211 and the rear wall portion 212 each further include an upper protruding piece 210*e* that protrudes upward (see FIGS. 1 to 3). The upper protruding piece 210*e* protrudes upward beyond the top end portion 210*c*. The upper protruding piece 210*e* of the front wall portion 211 is disposed substantially at a center thereof in the left-right direction. Likewise, the upper protruding piece 210*e* of the rear wall portion 212 is also disposed substantially at a center thereof in the left-right direction.

In a case where impact is applied to the packaging member 100 from above, the impact is first applied to the upper protruding pieces 210*e*, so that the upper protruding pieces 210*e* are crushed. Thereby, the impact on the packaged object 1000 is mitigated. That is, the upper protruding pieces 210*e* function as cushion members for mitigating impact from above.

The front wall portion 211 and the rear wall portion 212 each further include lower protruding pieces 210*f* (see FIGS. 1 and 2). Although FIGS. 1 and 2 do not show the lower protruding pieces 210*f* of the rear wall portion 212, the rear wall portion 212 is also provided with the lower protruding pieces 210*f*. The lower protruding pieces 210*f* of the front wall portion 211 are disposed one on each of the left and right sides thereof. Likewise, the lower protruding pieces 210*f* of the rear wall portion 212 are also disposed one on each of the left and right sides thereof.

The lower protruding pieces 210*f* are each such part of the lower edge of the outer wall 210*a* as protrudes downward beyond the rest of the lower edge of the outer wall 210*a*. Specifically, the lower protruding pieces 210*f* are each cut and erected from the bottom portion 1 to protrude downward beyond a lower surface of the bottom portion 1.

Thus, in a case where impact is applied to the packaging member 100 from below, for example, in a case where the bottom portion 1 is facing downward when the packaging member 100 has fallen, the impact is first applied to the lower protruding pieces 210*f*, so that the lower protruding pieces 210*f* are crushed. As a result, the impact on the packaged object 1000 is mitigated. That is, the lower protruding pieces 210*f* function as cushion members for mitigating impact from below.

Next, the pair of lateral wall portions 220 will be described.

As seen from above, the pair of lateral wall portions 220 extend parallel (including substantially parallel) to the front-rear direction. With the packaged object 1000 contained in the containing area 10, the pair of lateral wall portions 220 hold the packaged object 1000 therebetween in the left-right direction.

Figure 5:
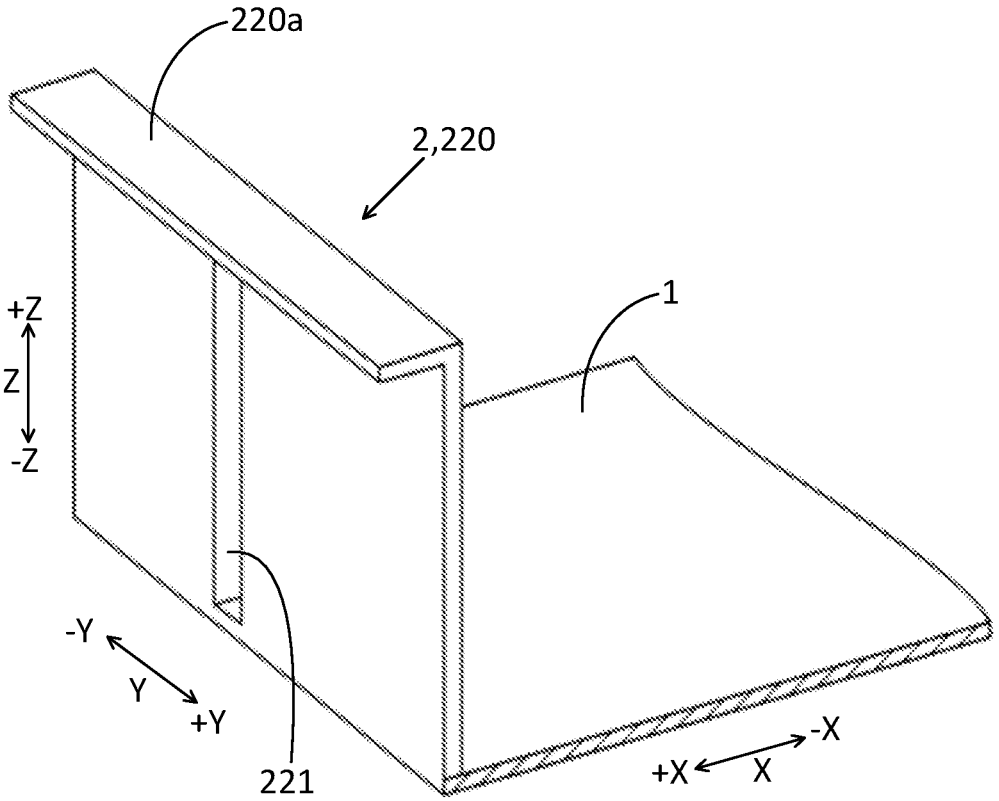
FIG. 5 is a perspective view of and around a lateral wall portion of a packaging member according to one embodiment.

The lateral wall portions 220 and their vicinities are structured as shown in FIG. 5. FIG. 5 only shows part of the bottom portion 1 and the lateral wall portion 220, and the other portions are unillustrated.

A lower edge of the lateral wall portion 220 is connected to the bottom portion 1. By a boundary between the bottom portion 1 and the lateral wall portion 220 being folded, the lateral wall portion 220 is brought into a state of being erected upward from the bottom portion 1. Further, the lateral wall portion 220 has a tongue piece 220*a*. The tongue piece 220*a* is formed by perpendicularly (including substantially perpendicularly) folding an upper edge portion of the lateral wall portion 220 outward in the left-right direction. In contrast to the front wall portion 211 and the rear wall portion 212 which each have a double-layer structure having the outer wall 210*a* and the inner wall 210*b*, the lateral wall portions 220 have a single-layer structure.

Edge portions of each of the front wall portion 211 and the rear wall portion 212 in the left-right direction protrude beyond base portions (portions other than the tongue pieces 220*a*) of the lateral wall portions 220 in directions outward from inside the containing area 10. Thus, in a case where impact is applied to the packaging member 100 from the left-right direction, the edge portions of the front wall portion 211 and of the rear wall portion 212 in the left-right direction are crushed, and thereby the impact on the packaged object 1000 is mitigated. That is, the edge portions of the front wall portion 211 and of the rear wall portion 212 in the left-right direction function as cushion members.

<Holding of Wall Portion>

The wall portion 2 is held in the state of being erected upward from the bottom portion 1 (that is, in the standing state). In other words, the wall portion 2 is held so as not to incline. The wall portion 2 has holding portions 230 for suppressing inclination thereof. The holding portions 230 are disposed one on each of left and right edge portions of the front wall portion 211. Further, the holding portions 230 are also provided one on each of left and right edge portions of the rear wall portion 212.

The holding portions 230 of the front wall portion 211 are portions that are perpendicularly (including substantially perpendicularly) folded rearward from the front wall portion 211 along folding lines extending in the up-down direction. The holding portions 230 of the rear wall portion 212 are portions that are perpendicularly (including substantially perpendicularly) folded frontward from the rear wall portion 212 along folding lines extending in the up-down direction.

Figure 6:
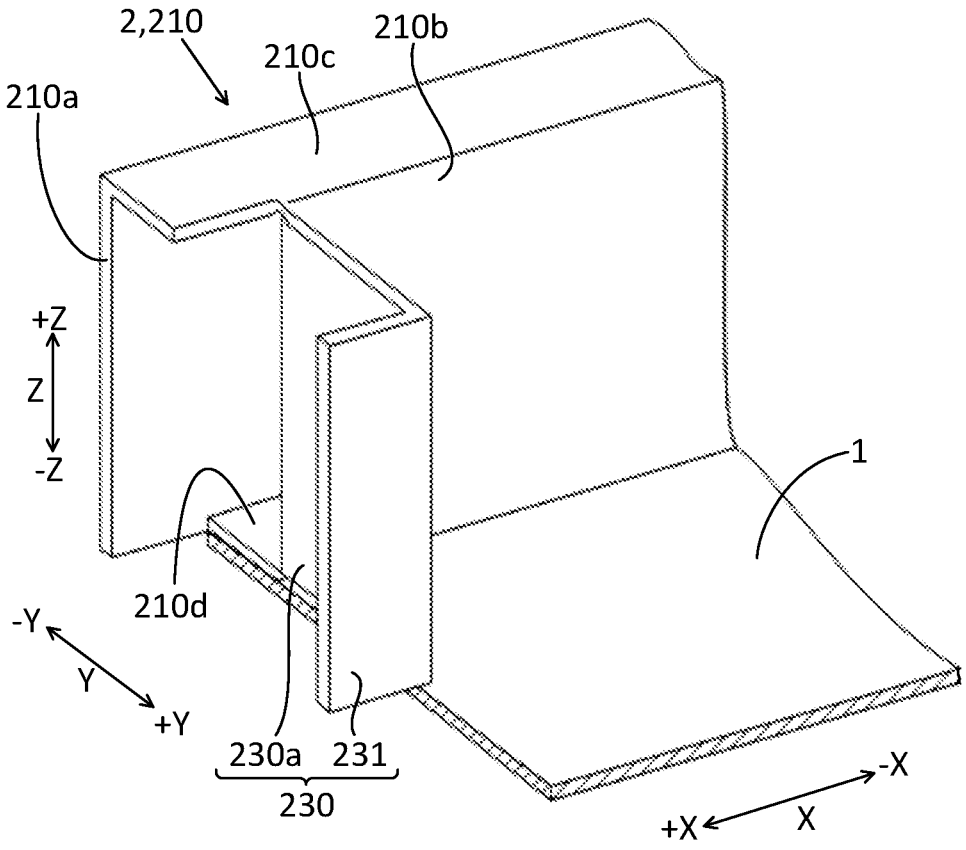
FIG. 6 is a perspective view of and around a holding portion of a packaging member according to one embodiment.
Figure 7:
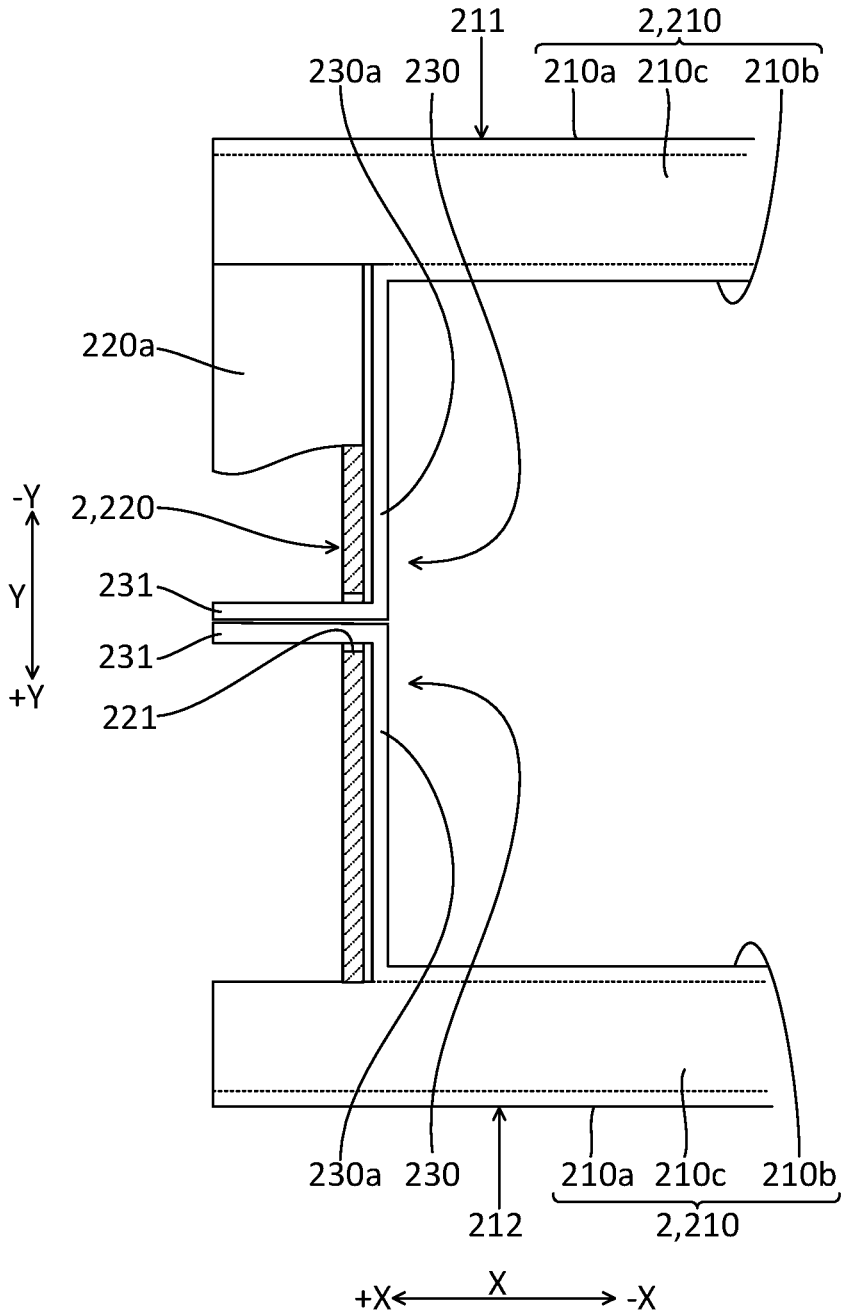
FIG. 7 is an enlarged view of area B enclosed by a dashed-and-double-dotted line in FIG. 3.

Hereinafter, with reference to FIGS. 6 and 7, a detailed description will be given of the holding portions 230. The holding portions 230 of the front wall portion 211 and of the rear wall portion 212 are identical in configuration. Thus, the description will be given without detailed illustration of the holding portions 230 of the front wall portion 211. In FIG. 7, part of the tongue piece 220*a* is omitted. Further, for clarity of representation, opposed portions 230*a* of the holding portions 230 are illustrated as being separate from the lateral wall portion 220 in the left-right direction, but they are actually in contact with each other.

The holding portions 230 are respectively connected to edges of the inner walls 210*b* in the left-right direction. The holding portions 230 extend respectively from opposite edges of the inner walls 210*b* in the left-right direction, and are folded in the front-rear direction to be perpendicular (including substantially perpendicular) to the inner walls 210*b*, and thereby extend in the front-rear direction. In other words, the holding portions 230 have the opposed portions 230*a* that are disposed opposite to inner surfaces of the lateral wall portions 220. The opposed portions 230*a* are disposed inside the containing area 10. Specifically, the opposed portions 230*a* are disposed at positions at which the opposed portions 230*a* contact the packaged object 1000 when the packaged object 1000 is contained in the containing area 10. Thus, with the packaged object 1000 contained in the containing area 10, the packaged object 1000 and the opposed portions 230*a* contact each other in the left-right direction (see FIG. 2).

Here, the lateral wall portions 220 have wall-portion slits 221. The wall-portion slits 221 penetrate the lateral wall portions 220 in the left-right direction (a thickness direction of such part of the cardboard sheet 110 as forms the lateral wall portion 220). Further, the wall-portion slits 221 are each a hole elongated in the up-down direction, and are formed substantially at center portions of the lateral wall portions 220 in the front-rear direction (see FIG. 5).

The holding portions 230 have insertion pieces 231, which are portions that are on a side opposite to the side of connection with the wall portions 210 and that are further folded in the left-right direction. Specifically, the insertion pieces 231 are formed by perpendicularly (including substantially perpendicularly) folding the opposed portions 230*a* of the holding portions 230 outward in the left-right direction. The insertion pieces 231 are inserted into the wall-portion slits 221.

The opposed portions 230*a* of the holding portions 230 are disposed inside the containing area 10. Thus, the insertion pieces 231 are inserted into the wall-portion slits 221 from inside the containing area 10. Then, by being inserted into the wall-portion slits 221, the insertion pieces 231 protrude from inside to outside of the containing area 10. In other words, the insertion pieces 231 protrude outward beyond outer surfaces (surfaces facing outward in the left-right direction) of the lateral wall portions 220. Leading edges of the insertion pieces 231 in the left-right direction are located at the same (including substantially the same) position as the edge portion of the front wall portion 211 and of the rear wall portion 212 in the left-right direction.

The opposed portions 230*a* of the holding portions 230 contact the packaged object 1000 inside the containing area 10, thereby being pressed from inside toward outside of the containing area 10. Thus, the insertion pieces 231 are held in a state of protruding from inside to outside of the containing area 10.

As a result, in a case where impact is applied to the packaging member 100 from the left-right direction, the insertion pieces 231 are crushed together with the edge portion of the front wall portion 211 and of the rear wall portion 212 in the left-right direction. Thereby, the impact on the packaged object 1000 is mitigated. That is, the insertion pieces 231, together with the edge portions of the front wall portion 211 and of the rear wall portion 212, function as cushion members for mitigating impact from the left-right direction.

Further, each of the insertion pieces 231 of each pair of the holding portions 230 is inserted into one of the wall-portion slits 221 that is disposed opposite thereto. Specifically, into the wall-portion slit 221 of the left-side one of the lateral wall portions 220, the insertion pieces 231 of the holding portions 230 respectively provided on the left side of the front wall portion 211 and of the rear wall portion 212 are inserted. Into the wall-portion slit 221 of the right-side one of the lateral wall portions 220, the insertion pieces 231 of the holding portions 230 respectively provided on the right side of the front wall portion 211 and of the rear wall portion 212 are inserted. That is, the insertion pieces 231 of two of the holding portions 230 disposed on the same side in the left-right direction are overlapped each other and together inserted into the same one of the wall-portion slits 221.

By the insertion pieces 231 being inserted into the wall-portion slits 221, it is possible to suppress inclination of the front wall portion 211 and of the rear wall portion 212 outward from the containing area 10. It is also possible to suppress inclination of the pair of lateral wall portions 220 outward from the containing area 10. That is, by inserting the insertion pieces 231 into the wall-portion slits 221, the front wall portion 211 and the rear wall portion 212 are each held in the standing state, and the pair of lateral wall portions 220 are each held in the standing state.

<Holding of Lid Portion>

As shown in FIGS. 1 to 3, the packaging member 100 includes a lid portion 3. The lid portion 3 is extended from the wall portion 2. And, the lid portion 3 covers part of the containing area 10 from above. For example, the lid portion 3 covers a substantially central portion of the containing area 10 in the left-right direction from above. When the packaged object 1000 is contained in the containing area 10, the lid portion 3 covers part (substantially central part in the left-right direction) of the packaged object 1000 from above.

For example, the lid portion 3 is connected to the top end portion 210*c* of the rear wall portion 212 so as to be extended from the top end portion 210*c* of the rear wall portion 212. However, this is not meant as a limitation. The lid portion 3 may instead be connected to the top end portion 210*c* of the front wall portion 211 so as to be extended from the top end portion 210*c* of the front wall portion 211. In the configuration where the lid portion 3 is connected to the top end portion 210*c* of the rear wall portion 212, the rear wall portion 212 corresponds to "one of a pair of first wall portions," and the front wall portion 211 corresponds to "the other one of the pair of first wall portions." The upper protruding piece 210*e* of the front wall portion 211 corresponds to a "first upper protruding piece," and the upper protruding piece 210*e* of the rear wall portion 212 corresponds to a "second upper protruding piece." In FIGS. 1 to 3 and 8, the upper protruding piece 210*e* of the front wall portion 211 is denoted by a sign 2101*e*, and the upper protruding piece 210*e* of the rear wall portion 212 is denoted by a sign 2102*e* to make a distinction between the two upward protruding pieces 210.

The lid portion 3 is pivotable about a connection portion thereof with the top end portion 210*c* of the rear wall portion 212 so as to swing a leading-edge portion thereof in the up-down direction, the leading-edge portion being on an opposite side of the connection portion. In other words, the lid portion 3 is pivotable in directions for closing and opening part of an opening of the containing area 10. Specifically, a boundary between the top end portion 210*c* of the rear wall portion 212 and the lid portion 3 is folded, and by adjusting an angle of the folding, part of the opening of the containing area 10 can be closed and opened by means of the lid portion 3.

Here, the lid portion 3 has a lid-portion slit 31. The lid-portion slit 31 penetrates such part of the cardboard sheet 110 as constitutes the lid portion 3 in a thickness direction thereof. When part of the containing area 10 is covered by the lid portion 3 from above, the lid-portion slit 31 is located so as to penetrate the lid portion 3 in the up-down direction.

Further, when part of the containing area 10 is covered by the lid portion 3 from above, the lid portion 3 is extended from the top end portion 210*c* of the rear wall portion 212 and folded, and thereby reaches the top end portion 210*c* of the front wall portion 211. Specifically, of the lid portion 3, the leading-edge portion, which is opposite to the connection portion thereof with the rear wall portion 212, reaches the top end portion 210*c* of the front wall portion 211. Here, the lid-portion slit 31 is formed in the leading-edge portion of the lid portion 3. Thus, when the leading-edge portion of the lid portion 3 reaches the top end portion 210*c* of the front wall portion 211, the upper protruding piece 210*e* of the front wall portion 211 (that is, the first upper protruding piece 2101*e*) is inserted into the lid-portion slit 31.

By inserting the upper protruding piece 210*e* of the front wall portion 211 (that is, the first upper protruding piece 2101*e*) into the lid-portion slit 31, the lid portion 3 is held in a state of covering part of the containing area 10 from above. In other words, the lid portion 3 closes part of a top opening of the containing area 10.

The top opening of the containing area 10 serves as an inlet/outlet port through which to put/take out the packaged object 1000 in/from the containing area 10. That is, after the packaged object 1000 is placed in the containing area 10, part of the top opening of the containing area 10 is closed by the lid portion 3. This helps suppress coming out of the packaged object 1000 through the top opening of the containing area 10.

Note that, as seen from above, the lid portion 3 closes only the substantially central part of the containing area 10 in the left-right direction, leaving the rest of the containing area 10 unclosed. That is, the rest of the containing area 10 is exposed. This makes it possible, while suppressing coming out of the packaged object 1000 through the top opening of the containing area 10, to easily check the state in the containing area 10 (the state of the packaged object 1000).

<Assembly of Packaging Member>

FIG. 8 shows a development view of the packaging member 100. The packaging member 100 is formed by folding the cardboard sheet 110 shown in FIG. 8. In FIG. 8, the upper surface of the bottom portion 1 (which serves not only as a placement surface on which to place the packaged object 1000 but also as a bottom surface of the containing area 10) is illustrated as facing upward. In FIG. 8, thick solid lines are cut lines, dashed lines are valley fold lines, and dashed-and-dotted lines are mountain fold lines.

By folding the cardboard sheet 110 shown in FIG. 8 and inserting the insertion pieces 231 into the wall-portion slits 221, the assembly is completed. That is, there is no need to combine a plurality of parts, and there is no need of a joining member such as an adhesive. Further, when discarding the packaging member 100, it can be unfolded back to a sheet just by taking the insertion pieces 231 out of the wall-portion slits 221 after taking the packaged object 1000 out of the containing area 10.

In the present embodiment, as described above, the wall portion 2 of the packaging member 100 has the holding portions 230, each pair of which are extended from opposite edges of each of the pair of wall portions 210 (the front wall portion 211 and the rear wall portion 212) and folded toward the front-rear direction. That is, the front wall portion 211 includes a pair of holding portions 230 which are folded in the front-rear direction from the opposite edges thereof in the left-right direction, and likewise, the rear wall portion 212 has a pair of holding portions 230 which are folded in the front-rear direction from the opposite edges thereof in the left-right direction. The pair of holding portions 230 have the opposed portions 230*a* which are disposed opposite to the inner surfaces of the lateral wall portions 220. Furthermore, the pair of holding portions 230 have the insertion pieces 231, which are each a portion that is on the side opposite to the side of connection with one of the wall portions 210 and that is further folded outward in the left-right direction. Moreover, the lateral wall portions 220 have the wall-portion slits 221 that penetrate them in the left-right direction. The insertion pieces 231 are inserted into the wall-portion slits 221. Thereby, the front wall portion 211 and the rear wall portion 212 are held in the state of being erected from the bottom portion 1. Likewise, the lateral wall portions 220 are also held in the state of being erected from the bottom portion 1.

With this configuration, merely by folding the single cardboard sheet 110 along the valley fold lines and the mountain fold lines and then inserting the insertion pieces 231 into the wall-portion slits 22, the front wall portion 211 and the rear wall portion 212 can be held in the state of being erected from the bottom portion 1, and the lateral wall portions 220 can be held in the state of being erected from the bottom portion 1. That is, the packaging member 100 having the containing area 10 can be easily obtained without combining a plurality of parts (that is, with only a single part).

Further, in a discarding process of the packaging member 100, the packaging member 100 can be unfolded into a sheet just by taking the insertion pieces 231 out of the wall-portion slits 221. At this time, the packaging member 100 is not disassembled into a plurality of parts. Thus, there is no need to take the trouble of separating and bundling the targets of the discarding process.

As a result of these advantages, the assembly and the disassembly (the discarding process) of the packaging member 100 can be performed with improved workability. Further, the packaging member 100 is composed of a single member (the cardboard sheet 110), and this helps achieve cost reduction of the packaging member 100.

Further, in the present embodiment, as described above, the insertion pieces 231 are inserted into the wall-portion slits 221 to protrude from inside to outside of the containing area 10. Specifically, the insertion pieces 231 protrude outward beyond the outer surfaces of the lateral wall portions 220 (surfaces opposite to the surfaces facing the containing area 10) in the left-right direction. This allows the insertion pieces 231 to function as cushion members.

Further, in the present embodiment, as described above, the opposed portions 230*a* of the holding portions 230 are disposed at positions at which the opposed portions 230*a* contact the packaged object 1000 when the packaged object 1000 is contained in the containing area 10. This helps prevent the insertion pieces 231 from positionally deviating inward in the left-right direction to come off from the wall-portion slits 221. That is, when the packaged object 1000 is contained in the containing area 10, it is possible to prevent the packaging member 100 from becoming unfolded (the packaging member 100 will not be unintentionally unfolded).

Further, in the present embodiment, as described above, the insertion pieces 231 of two holding portions 230 disposed on the same side in the left-right direction are inserted into the same one of wall-portion slits 221. This helps reduce the number of positions at which the wall-portion slits 221 are to be formed.

Further, in the present embodiment, as described above, by the upper protruding piece 210*e* (that is, the first upper protruding piece 2101*e*) being inserted into the lid-portion slit 31, the lid portion 3 is held in a state of closing, from above, the substantially central portion of the containing area 10 in the left-right direction as seen from above. This helps suppress unintentional opening of the lid portion 3.

Further, in the present embodiment, as described above, the upper protruding piece 210*e* is provided on each of the front wall portion 211 and the rear wall portion 212. The upper protruding piece 210*e* of the front wall portion 211 (that is, the first upper protruding piece 2101*e*) and the upper protruding piece 210*e* of the rear wall portion 212 (that is, the second upper protruding piece 2102*e*) crush when impact is applied thereto from above, and thereby function as cushion members for mitigating the impact. That is, the upper protruding piece 210*e* inserted into the lid-portion slit 31 (that is, the first upper protruding piece 2101*e*) functions not only as a holding portion for holding the lid portion 3 stationary but also as a cushion member. With this configuration, there is no need to form a dedicated holding portion for holding the lid portion 3, and thus it is possible to suppress complexity of the structure of the packaging member 100.

Further, in the present embodiment, as described above, the front wall portion 211 and the rear wall portion 212 have the lower protruding pieces 210*f* protruding downward beyond the bottom portion 1. Each of the lower protruding pieces 210*f* of the front wall portion 211 and of the rear wall portion 212 is cut and erected from the bottom portion 1 to protrude downward beyond the bottom portion 1. The lower protruding pieces 210*f* of the front wall portion 211 and of the rear wall portion 212 each crush when impact is applied thereto from below, thereby mitigating the impact. Thus, without preparing an extra part, cushion members can be easily obtained to mitigate the impact from below.

It should be understood that the embodiment disclosed herein is an example in all aspects and do not limit the implementation of the present invention in any way. The scope of the present invention is indicated not by the above description of the embodiment but by the scope of claims for patent, and all changes and modifications within the meaning and scope equivalent to the scope of claims for patent are intended to be included.

The invention claimed is:

1. A packaging member having a containing area formed by folding a single cardboard sheet, the packaging member comprising:

a bottom portion having a rectangular shape; and a wall portion that is folded from a perimeter of the bottom portion to be erected upward, wherein the wall portion, as seen from above, surrounds the containing area, the wall portion has a pair of first wall portions that are disposed opposite to each other across the containing area in a first direction, and that are each folded inward into a polygonal-tube shape, a pair of second wall portions that are disposed opposite to each other across the containing area in a second direction orthogonal to the first direction, and a pair of holding portions that are folded, toward the first direction, from opposite edges of each of the pair of first wall portions in the second direction the pair of holding portions each have opposed portions disposed opposite to inner surfaces of the second wall portions, and insertion pieces formed by further folding, toward the second direction, sides of the pair of holding portions opposite to sides of connection with the first wall portions, the second wall portions each have a wall-portion slit, and, by inserting the insertion pieces in the wall-portion slit, the first wall portions and the second wall portions are held in a standing state, wherein the wall portion has a pair of the holding portions at each of opposite sides thereof in the second direction, the pair of second wall portions each have the wall-portion slit, and the insertion pieces of each of the pair of holding portions at each of the opposite sides of the wall portion in the second direction are inserted in the wall-portion slit disposed opposite to the insertion pieces.

2. The packaging member according to claim 1, wherein, in a state of being inserted in the wall-portion slit, the insertion piece protrudes from inside to outside of the containing area.

3. The packaging member according to claim 2, wherein the opposed portions is disposed at a position at which the opposed portions contact a packaged object when the packaged object is contained in the containing area.

4. The packaging member according to claim 1, wherein the pair of first wall portions have a pair of lower protruding pieces that are cut and erected from the bottom portion so as to protrude downward beyond the bottom portion, and the pair of lower protruding pieces crush when impact is applied thereto from below, thereby mitigating the impact.

5. A packaging member having a containing area formed by folding a single cardboard sheet, the packaging member comprising:

a bottom portion having a rectangular shape; and a wall portion that is folded from a perimeter of the bottom portion to be erected upward, a lid portion, wherein the wall portion, as seen from above, surrounds the containing area, the wall portion has a pair of first wall portions that are disposed opposite to each other across the containing area in a first direction, and that are each folded inward into a polygonal-tube shape, a pair of second wall portions that are disposed opposite to each other across the containing area in a second direction orthogonal to the first direction, and a pair of holding portions that are folded, toward the first direction, from opposite edges of each of the pair of first wall portions in the second direction, the pair of holding portions each have opposed portions disposed opposite to inner surfaces of the second wall portions, and insertion pieces formed by further folding, toward the second direction, sides of the pair of holding portions opposite to sides of connection with the first wall portions, the second wall portions each have a wall-portion slit, and, by inserting the insertion pieces in the wall-portion slit, the first wall portions and the second wall portions are held in a standing state, wherein the lid portion that is connected to an upper edge portion of one of the pair of first wall portions, and that is folded toward the first direction, the lid portion, as seen from above, closes part of a top opening of the containing area, an upper edge portion of an other one of the pair of first wall portions has a first upper protruding piece that protrudes upward beyond the lid portion, the lid portion has a lid-portion slit into which the first upper protruding piece is inserted, and by the first upper protruding piece is inserted in the lid-portion slit.

6. The packaging member according to claim 5, wherein an upper edge portion of one of the pair of first wall portions has a second upper protruding piece that protrudes upward beyond the lid portion, and the first upper protruding piece and the second upper protruding piece crush when impact is applied thereto from above, thereby mitigating the impact.

7. The packaging member according to claim 5, wherein, in a state of being inserted in the wall-portion slit, the insertion piece protrudes from inside to outside of the containing area.

8. The packaging member according to claim 7, wherein the opposed portions is disposed at a position at which the opposed portions contact a packaged object when the packaged object is contained in the containing area.

9. The packaging member according to claim 5, wherein the pair of first wall portions have a pair of lower protruding pieces that are cut and erected from the bottom portion so as to protrude downward beyond the bottom portion, and the pair of lower protruding pieces crush when impact is applied thereto from below, thereby mitigating the impact.

* * * * *